US007886408B2

(12) United States Patent
Lautenschläger

(10) Patent No.: US 7,886,408 B2
(45) Date of Patent: Feb. 15, 2011

(54) FURNITURE HINGE WITH A DAMPING DEVICE

(75) Inventor: Horst Lautenschläger, Reinheim (DE)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 0 days.

(21) Appl. No.: 11/945,354

(22) Filed: Nov. 27, 2007

(65) Prior Publication Data

US 2008/0141490 A1 Jun. 19, 2008

(30) Foreign Application Priority Data

Dec. 15, 2006 (DE) ..... 10 2006 059 247

(51) Int. Cl.
*E05F 1/08* (2006.01)

(52) U.S. Cl. ..... 16/286

(58) Field of Classification Search ..... 16/286
See application file for complete search history.

(56) References Cited

U.S. PATENT DOCUMENTS 4,184,228 A * 1/1980 Lautenschlager et al. ... 16/86 A
6,374,459 B1 * 4/2002 Zetti ..... 16/366
7,100,241 B2 * 9/2006 Zetti ..... 16/304
7,275,285 B1 * 10/2007 Lorell et al. ..... 16/321
2003/0200625 A1 * 10/2003 Zimmer ..... 16/306
2006/0090296 A1 * 5/2006 Zetti ..... 16/302
2007/0157429 A1 * 7/2007 Gallasch et al. ..... 16/238
2008/0134464 A1 * 6/2008 Salice ..... 16/84

FOREIGN PATENT DOCUMENTS

EP 144628 A2 * 6/1985

* cited by examiner

*Primary Examiner*—Victor Batson
*Assistant Examiner*—Matthew Sullivan
(74) *Attorney, Agent, or Firm*—Carlson, Gaskey & Olds, PC

(57) ABSTRACT

An example furniture hinge includes a damping device having a linearly movable damping cylinder, which is hingably connected to a door stop element and a damping guidance element. When closing the furniture hinge, the damping guide element can be pivoted against a pivot stop on the body fastening element.

16 Claims, 8 Drawing Sheets

FURNITURE HINGE WITH A DAMPING DEVICE

CROSS REFERENCE TO RELATED APPLICATIONS

This application claims priority to German Patent Application No. 10 2006 059 247.6, which was filed on 15 Dec. 2006.

BACKGROUND OF THE INVENTION

The invention relates to a furniture hinge with a door stop element and dampening device.

Closing forces generated when closing a furniture door cause the furniture door to impact the furniture body. Closing forces are particularly high when rapidly closing the furniture door. For reducing the shock and the noise associated with closing forces, it is known to install bumpers on the furniture body or on the furniture door. However, only a small amount of closing force is absorbed with the bumpers due to the thickness of the bumper.

In other known furniture hinges such as the furniture hinge described in United States Patent Application No. 2004/0205935 A1, a piston rod of a damping cylinder attaches to a furniture stop element projecting toward the furniture door. When closing the furniture door, the door stop element contacts the free end of the piston rod, which reduces the movement of the furniture door. An undesirable impact noise is generated in such an arrangement because of the impact of the door stop element on the free end of the piston rod.

In other known damped furniture hinges, such as the hinge described in EP Patent No. 1 538 293 B1, a rotary damper is seated on the body fastening element and is connected with the door stop element via the damping guidance element. The damping effect exists during the entire closing movement of the furniture hinge so that a damping force opposing the closing movement is already acting at the start of the closing movement. This complicates and slows pivoting ability of the furniture door during the first portion of the closing movement. Also, the structure of such hinges is comparatively large.

SUMMARY

An example furniture hinge includes a damping device having a linearly movable damping cylinder, which hingably connects a door stop element and a damping guidance element. When closing the furniture hinge, the damping guide element can be pivoted against a pivot stop on the body fastening element.

In contrast to a rotary damping device, the damping cylinder, which has a joint on each of its two ends, exerts a damping action not in the course of a pivot movement, but during a linear change between the two joints. The two-link damping chain, consisting of the damping cylinder and the damping guidance device, moves without a damping effect during the larger portion of the closing movement of the furniture hinge. When the pivot stop for the damping guidance device becomes effective toward the end of the closing movement of the furniture hinge, the damping cylinder becomes fixed relative to the body fastening element. From this pivot movement onward, the joint connecting the damping guide device with the damping cylinder constitutes a fixed point relative the body fastening element, which supports the damping cylinder. Then, in the course of the continued closing movement of the furniture door, the effective length of the damping cylinder is reduced, which produces a damping force counteracting the closing movement.

The damping force continues until the end of the closing movement and therefore brakes the furniture door prior to impacting on the furniture body. The damping guidance device releases from the pivot stop on the body fastening element when the furniture door is opened, so that no damping action counteracts the opening movement. When opening, the damping cylinder reverts to its original length without exerting a damping force.

In one example embodiment, the damping guidance device has a stop face which, toward the end of the closing movement, comes to rest against an abutment face on the body. The abutment face can be embodied on the furniture body or on the body fastening element.

BRIEF DESCRIPTION OF THE DRAWINGS

These and other features of the present invention can be best understood from the following specification and drawings, the following of which is a brief description.

DETAILED DESCRIPTION OF THE PREFERRED EMBODIMENT

Figure 1:
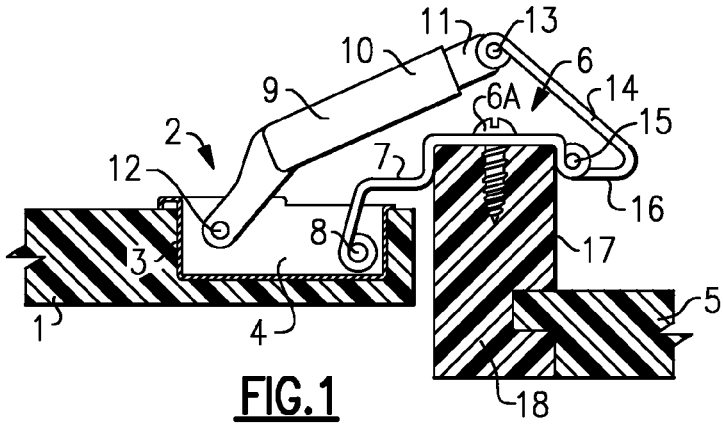
FIG. 1 shows a single-joint furniture hinge with a damping device in a position corresponding to an open door.
Figure 2:
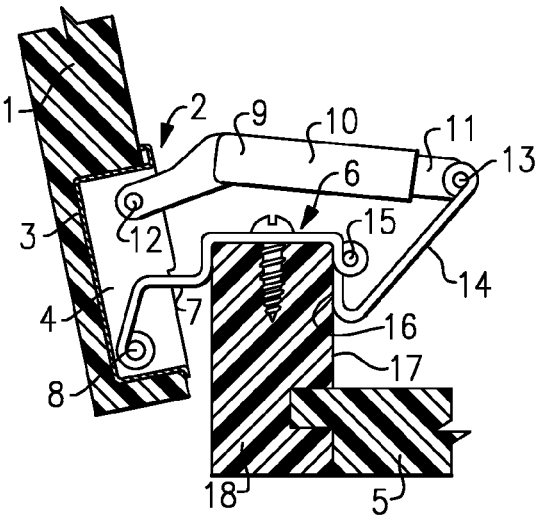
FIG. 2 shows the FIG. 1 furniture hinge in a position corresponding to a partially closed door and the damping device at the start of damping.
Figure 3:
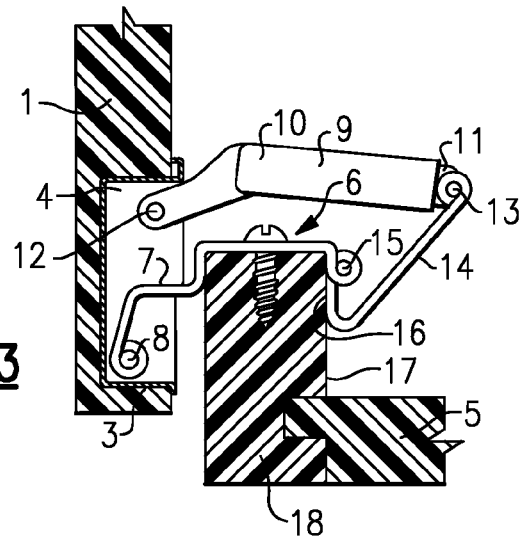
FIG. 3 shows the FIG. 1 furniture hinge in a position corresponding to a closed door.

Referring to FIGS. 1 to 3, an example furniture hinge includes a door fastening element 2 secured to a furniture door 1 through an insertion cup 4, which can be introduced into a cup bore 3 of the furniture door 1.

A body fastening element 6 secures to a furniture body 5 with a fastening screw 6*a*. In this example, the body fastening element 6 is arranged relative the furniture body 5 in a "face-frame" type of construction. A support arm 7, a type of pivot arm, rigidly fastens to the furniture body 5, and is seated on the door fastening element 2 on a joint 8 inside the insertion cup 4.

An example damping device includes a linearly movable damping cylinder 9 having a damping piston received in a linearly movable manner within a cylinder housing 10. A damping medium (such as a fluid or gas) flowing between damping bores in the course of the piston movement, causes damping of the piston movement. The piston (not shown) connects to a piston rod 11 extending from the cylinder housing 10. Damping cylinders of this type are known.

At one end of the cylinder near the door, the damping cylinder 9 pivotably seats to the insertion cup 4 through a joint 12 on the door fastening element 2. At another end of the cylinder near the furniture body, the damping cylinder 9 is pivotably connected through a joint 13 to a damping guidance device 14, which is hingedly seated in a joint 15 on the body fastening element 6.

Thus, the damping cylinder 9, together with the damping guidance device 14, generally define a two-link damping chain, connecting the door fastening element 2 with the body fastening element 6. When moving the furniture door 1 between the open position FIG. 1 and the partially closed position of FIG. 2, in which the furniture door 1 is still partially open, the damping cylinder 9 and the damping guidance device 14 move freely, without exerting a force on the furniture door 1.

An end of the damping guidance device 14 on the body side acts on the joint 15. Near this end, the damping guidance device 14 is angled off in such a way that its has a stop face 16 which, in the initial position represented in FIG. 1, extends approximately at sight angles relative to an abutment face 17 at the rear of the frame 18 of the furniture body 5.

As the furniture door 1 approaches the position represented in FIG. 2, little or no damping forces occur, because the effective length of the damping cylinder 9 has not been changed. Toward the end of the closing movement of the furniture hinge, the stop face 16 of the damping guidance device 14 comes to rest against the abutment face 17 on the body side limiting pivoting of the damping guidance device 14. The damping guidance device 14 remains in the position represented in FIG. 2 as the furniture door 1 moves to the closed position represented in FIG. 3. Further, moving the joint 12 at the door side toward the joint 13 effectively shortens the damping cylinder 9. Because of the movement of the piston inside the damping cylinder 9, the damping cylinder 9 now exerts a damping force on the furniture door 1, which counteracts the closing movement. Thus, closing movements of the furniture door 1 are braked during the latter portion of closing movements.

Figure 4:
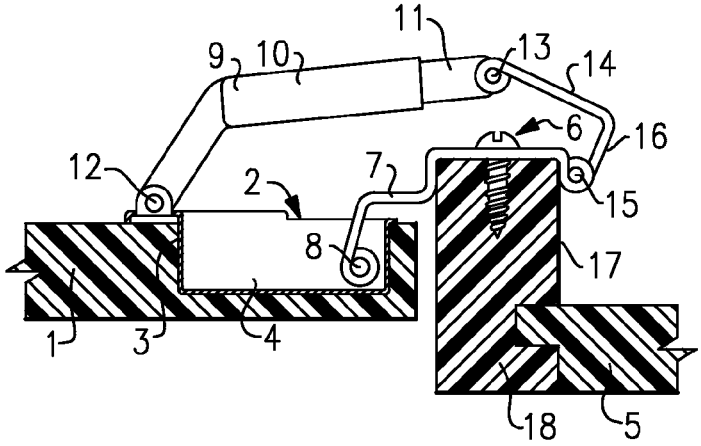
FIG. 4 shows another example furniture hinge with a damping device in a position corresponding to an open door.
Figure 5:
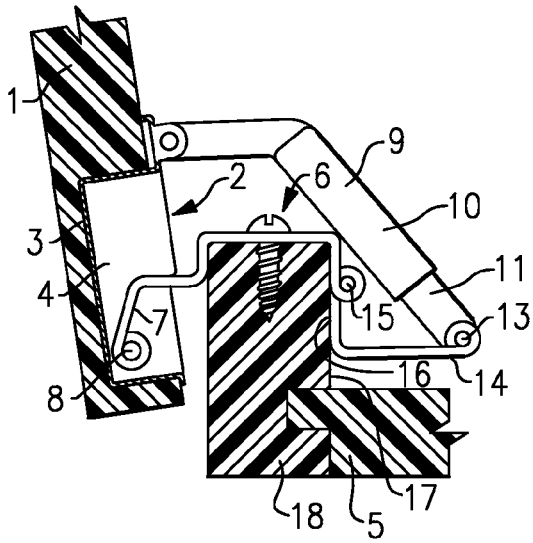
FIG. 5 shows the FIG. 4 furniture hinge in a position corresponding to a partially closed door and the damping device at the start of damping.
Figure 6:
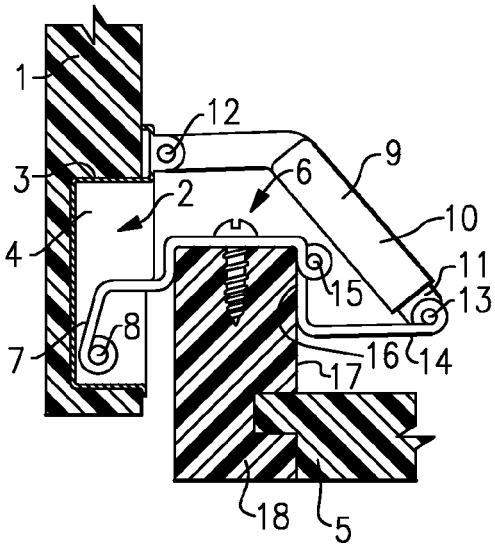
FIG. 6 shows the FIG. 4 furniture hinge in a position corresponding to a closed door.

In the example embodiment of FIGS. 4 to 6, the joint 12, near the door side of the damping cylinder 9 lies at the edge of the insertion cup 4, and is located outside the cup bore 3. In FIGS. 1 to 3, this joint 12, as well as the joint 8 of the support arm 7, lie within the interior of the insertion cup 4 inside the cup bore 3.

In the example of FIGS. 4 to 6, the damping guidance device 14 is beveled off at right angles, for example. Other bevel angles are also possible.

Figure 7:
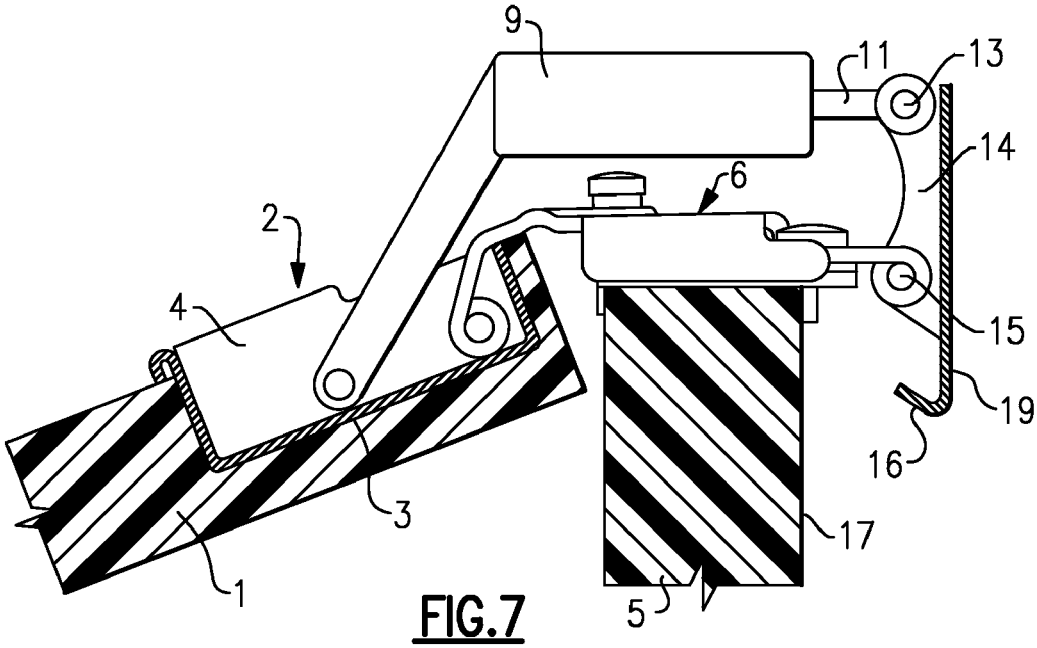
FIG. 7 shows yet another example furniture hinge in a position corresponding to an open door.
Figure 8:
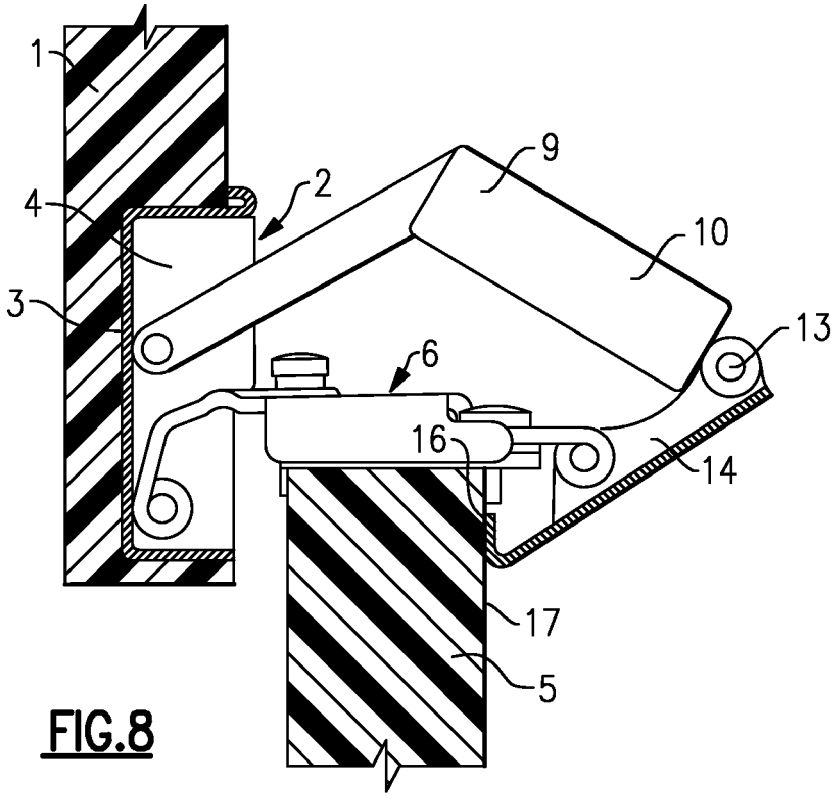
FIG. 8 shows the FIG. 7 furniture hinge in a position corresponding to a closed door.

Referring now to FIGS. 7 and 8, in this example, the damping guidance device 14 has an extension 29 past its joint 15, which is angled off for constituting the stop face 16. As represented in FIG. 8, as the furniture door 1 moves toward a closed position, the stop face 16 contacts the abutment face 17 at the side of the body which holds the damping guidance device 14 in the position of FIG. 8. In this position, the joint 13 supports the piston rod 11 of damping cylinder 9, so that during the last portion of the closing movement of the furniture hinge, the piston rod, along with the piston attached thereto, moves relative the cylinder housing 10 of the damping cylinder and imparts a damping effect on the door movement only in this phase.

Figure 9:
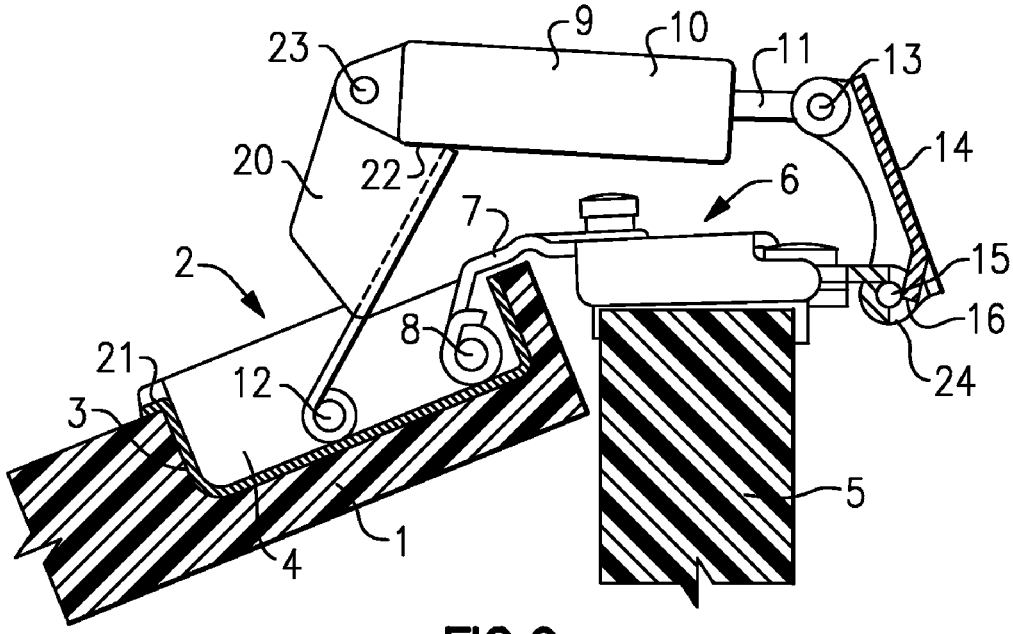
FIG. 9 shows yet another example furniture hinge in a position corresponding to an open door.
Figure 10:
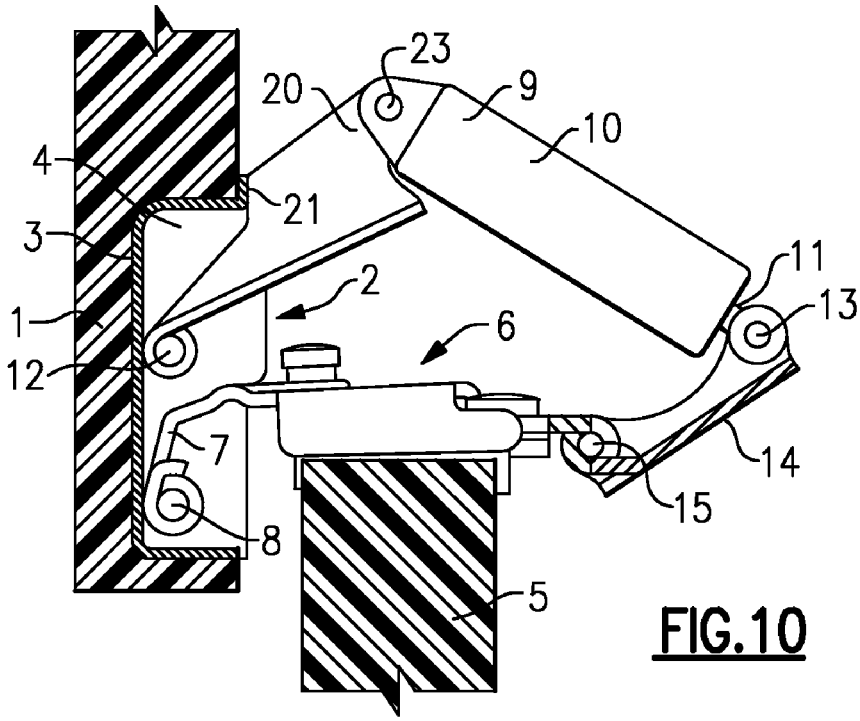
FIG. 10 shows the FIG. 9 furniture hinge in a position corresponding to a closed door.

Referring now to FIGS. 9 and 10, in this example, the damping cylinder 9 hingedly connects with the door fastening element 2 through a guide element 20 which, in the course of the closing movement of the furniture hinge, can be pivoted against a stop 21 on the door. FIG. 9 shows the furniture hinge in the open position of the door. In this example, the guide element 20 pivots against a stop 22 on the damping cylinder 9 during the opening movement of the furniture hinge.

When closing the furniture hinge, the furniture door 1 pivots from the position represented in FIG. 9 to the closed position represented in FIG. 10. In such a closed position, the guide element 20 guiding the closing movement rests against the stop 21 which, in this example, is formed at the edge of the insertion cup 4 providing the door stop element. In this position, the guide element 20 is rigidly fixed on the insertion cup 4 and, during the continued closing movement of the furniture door 1, presses on the damping cylinder 9 though a joint 23. The damping guidance device 14 includes a stop face 16 for contacting an abutment face 24 within the joint 15. Starting with the open door position (FIG. 9), the damping guidance device 14 is pivoted into the position shown in FIG. 10 and is held there by the guide element 20, so that during the continued pivoting of the furniture door 1, the cylinder housing 10 of the damping cylinder 9 is displaced relative to the piston rod 11, which produces the desired damping effect during the latter portions the closing movements.

Since the pivot movement of the damping guidance device 14 is limited by the abutment face 24 within the joint 15, and since no stop against the abutment face 17 on the body side (as described in the examples of FIGS. 7 to 8) takes place, resetting the closing position of the furniture door 1 has no effect on the damping process.

Figure 11:
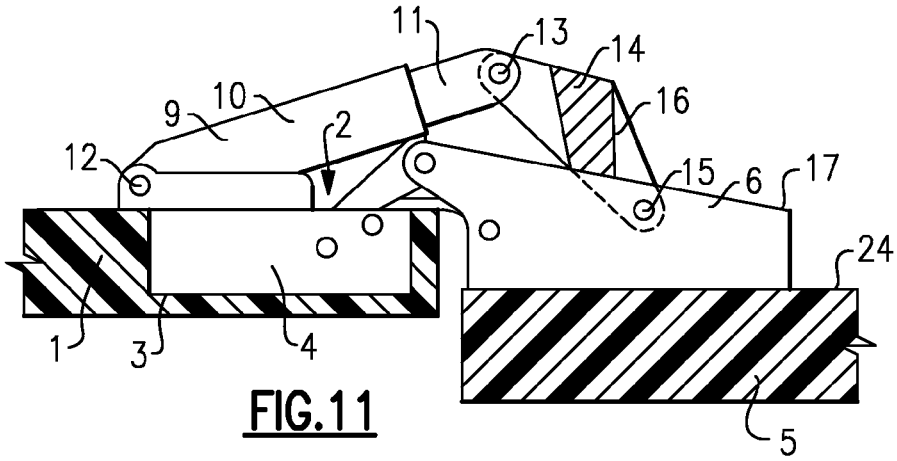
FIG. 11 shows yet another example furniture hinge in a position corresponding to an open door.
Figure 12:
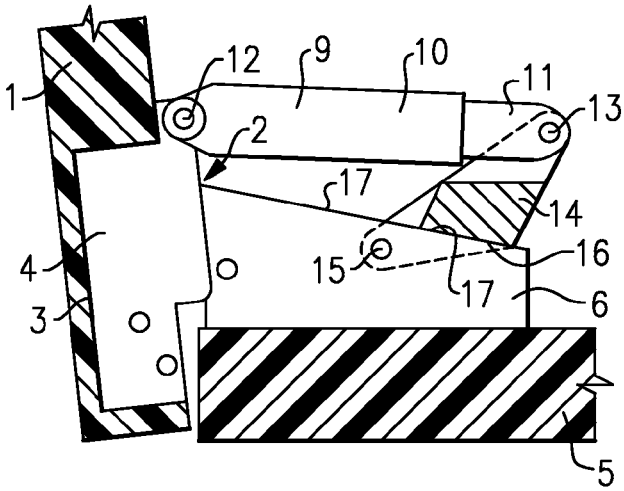
FIG. 12 shows the FIG. 11 furniture hinge in a position corresponding to a partially closed door and the damping device at the start of damping.
Figure 13:
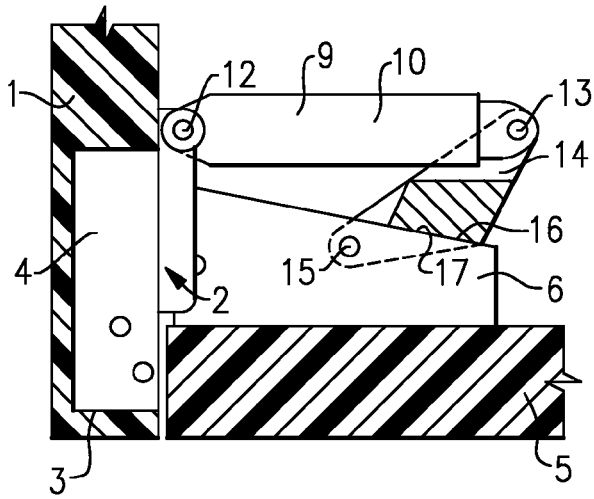
FIG. 13 shows the FIG. 11 furniture hinge in a position corresponding to a closed door.

In the example hinge of FIGS. 11 to 13, the damping guidance device 14 is seated on the top of the body fastening element 6 in the joint 15. In this case, the body fastening element 6 is attached to the inner face of the furniture body 5.

Starting with the completely open door position represented in FIG. 11, the damping guidance device 14 is pivoted in the course of the closing movement until its stop face 16 rests against the top of the body fastening element 6, which comprises the abutment face 17 in this example.

Pivoting the furniture door 1 further from this position to the closed position represented in FIG. 13, reduces the distance between the joints 12 and 13 of the damping cylinder 9. Relative movement between the cylinder housing 10 and the piston rod then provide the damping effect in the previously described manner.

Figure 14:
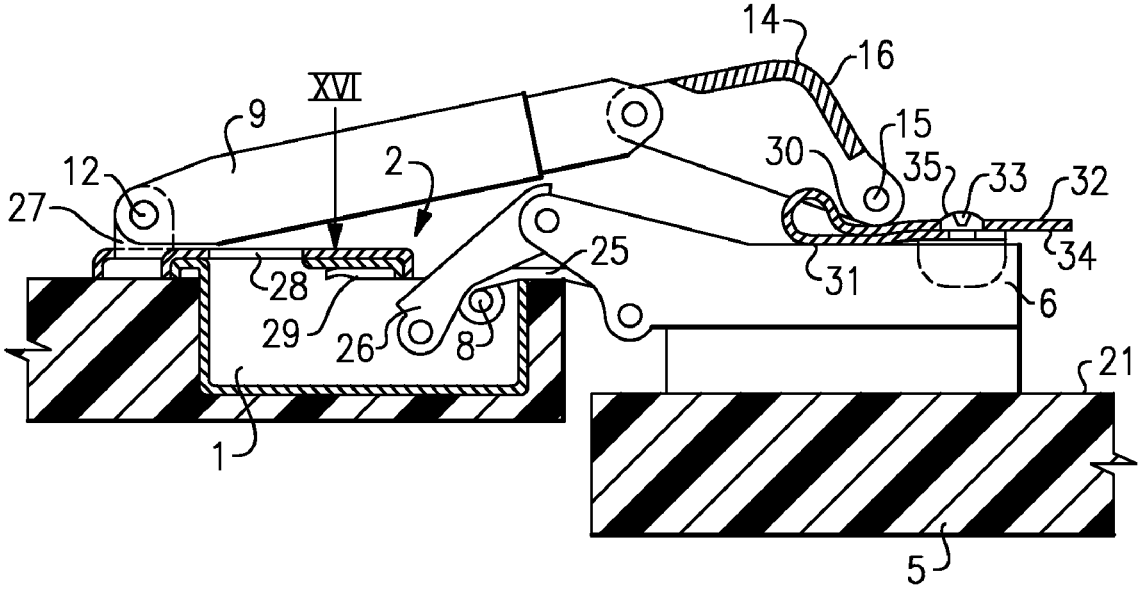
FIG. 14 shows an example multi-joint furniture hinge in a position corresponding to an open door.
Figure 15:
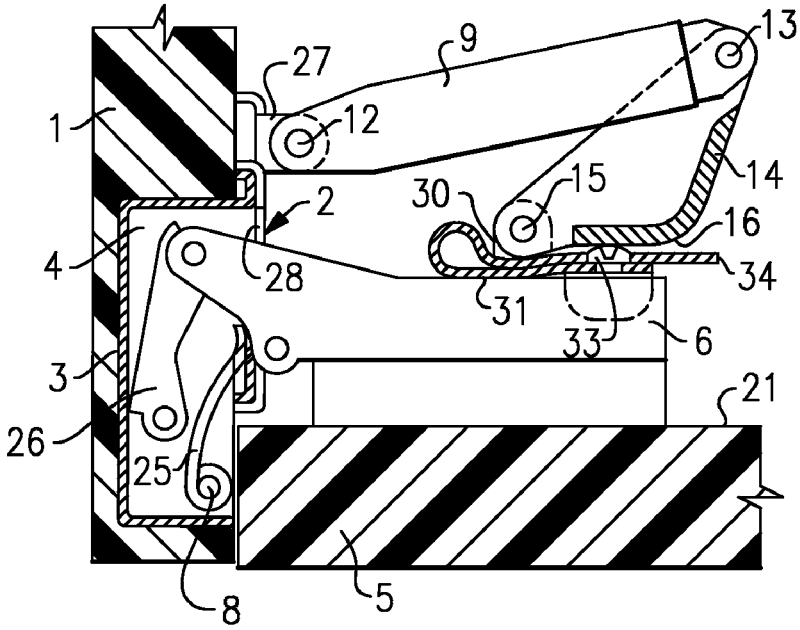
FIG. 15 shows the FIG. 14 furniture hinge in a position corresponding to a closed door.
Figure 16:
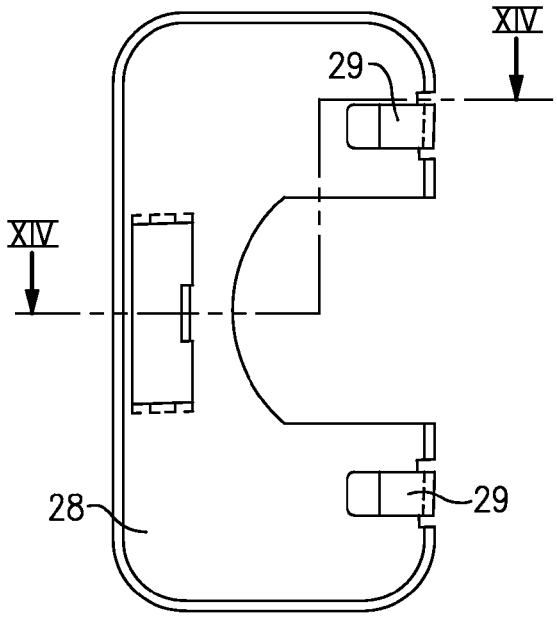
FIG. 16 shows a partial view of the FIG. 14 hinge along the direction of the arrow XVI.

FIGS. 14 and 15 show the multi-joint hinge in the open door position and in the closed door position respectively. The door fastening element 2, here the insertion cup 4, and the body fastening element 6 fastened on the inner body face 21, are connected with each other by two guide elements 25, 26. The pivot arm, as described in previous examples, is seated on the door fastening element 2 and is represented in this example by one of the two hinge guide elements 25, 26. Here, the damping cylinder 9 is connected with the door fastening element 2 through a joint element 27, which is releasably arranged on the door fastening element 2. The joint element 27 includes a plate 28, which is releasably suspended with its crimped-over edge 29 on the door fastening element 2. FIG. 16 shows the plate 28 in a view from above. The section line XIV-XIV represents the course of the section line in FIGS. 14 and 15.

The joint 15 on the body side of the body damping guidance device 14 seats on a joint element 30 to connect the damping guidance device 14 with the body fastening element 6. The joint element 30 has joint flaps for the joint 15, which fold upward from a sheet metal plate 31. A slit 32, open at the front, of the sheet metal plate 31 is pushed underneath a neck screw 33. In the installed state, an upper sheet metal plate 34 folded over with the sheet metal plate 31, extends with an opening 35 over the head of the neck screw 33 and in the process fixes the joint element 30 in place on the body fastening element 6.

In the closed state of the furniture door 1 (FIG. 15), the stop face 16 of the damping guidance device 14 comes to rest against the head of the neck screw 33, which constitutes the abutment face for the damping guidance device 14. In this contact position the joint 13 of the damping guidance device 14 solidly supports the damping cylinder 9.

The linkage, represented in FIGS. 14 and 15, of the damping cylinder 9, as well as of the damping guidance device 14, with the releasably attached plate 28, or the sheet metal plate 34, makes possible the retrofitting of a furniture hinge with a damping device. Such an arrangement can also be useful to provide the linkage with the releasable plate 28 only at the door side joint 12 of the damping cylinder 9, while the linkage of the damping guidance device 14 takes place rigidly through the joint 15 directly on the body fastening element 6. Such an arrangement facilitates mounting the plate 28 apart from the insertion cup 4, so that the top of the body fastening element 6 is freely accessible for providing an adjustment of the hinge. After the hinge adjustment has been performed, the plate 28, to which the damping cylinder 9 is hinged, attaches to the hinge by suspending it from the top of the insertion cup 4. The plate 28 can be later released from the insertion cup 4, if further adjustments are desired or accessing the adjustment screws on the top of the body fastening element 6 is otherwise desired.

Figure 17:
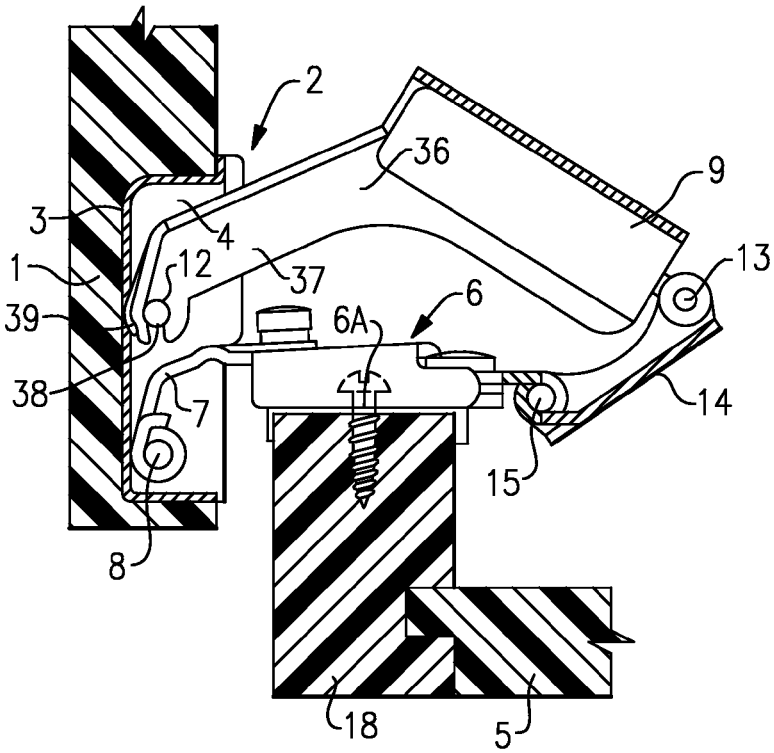
FIG. 17 shows an example furniture hinge having a snap-in connection between the damping cylinder and the door fastening element.
Figure 18:
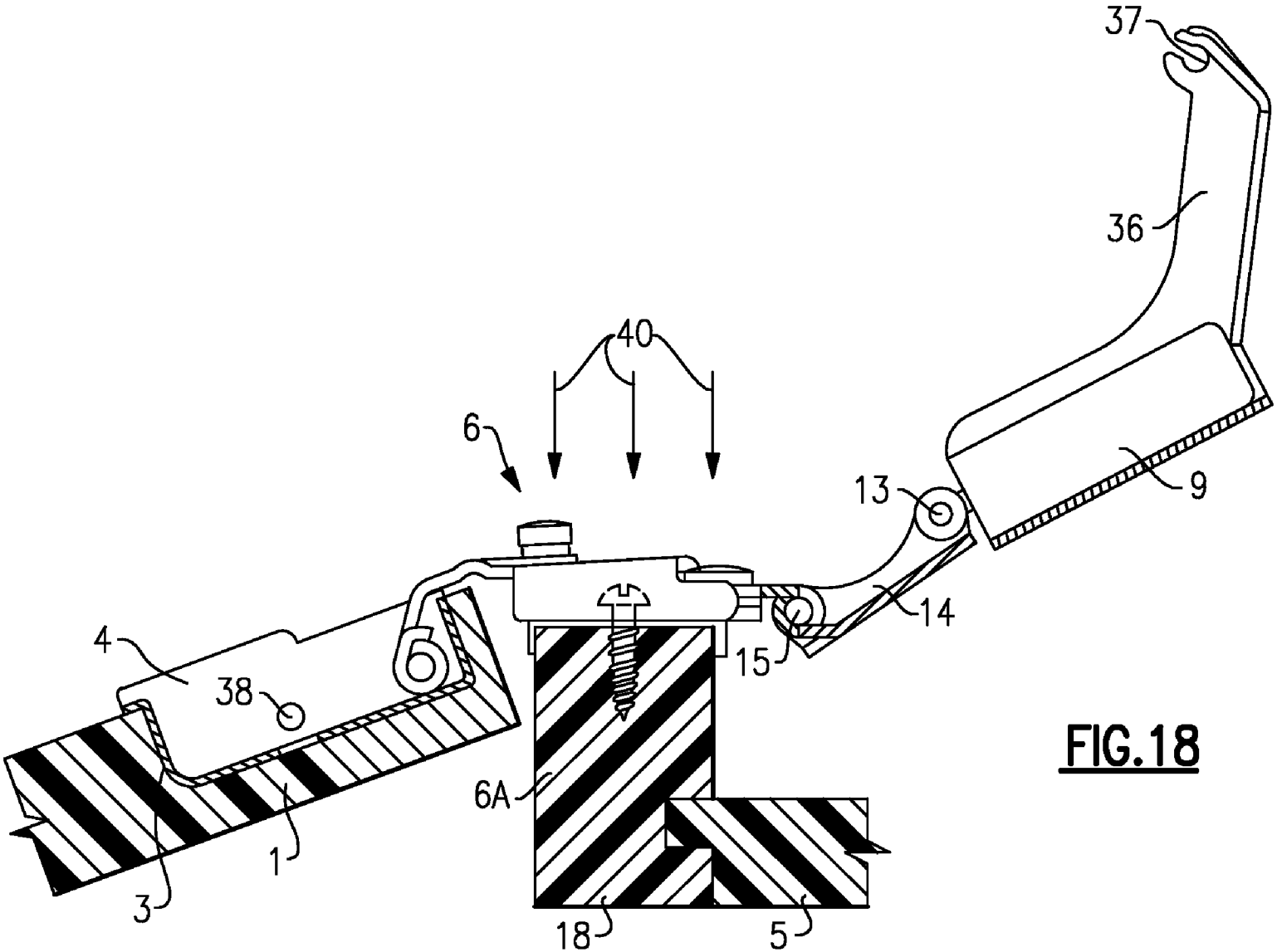
FIG. 18 shows the FIG. 17 furniture hinge with the snap-in connection in a released position.

An example single-joint furniture hinge is represented in FIGS. 17 and 18. The insertion cup 4 constituting the door fastening element 2 inserts into the cup bore 3 of the furniture door 1. The body fastening element 6 adjustably connects to the support arm 7, which is seated in the insertion cup 4 on the joint 8 and constitutes the pivot joint of the furniture door 1. As described in the example of FIGS. 9 and 10, the damping guidance device 14 seats within the joint 15 at the body side end of the body fastening element 6, and pivots into the position represented in FIG. 17. A stop in the joint 15 limits pivoting movements. The damping guidance device 14 is hingedly connected by means of the joint 13 with the piston rod of the damping cylinder 9.

Near the door the damping cylinder 9 rigidly connects with a connecting arm 36, which can be snapped into the insertion cup 4 by means of a spring-mountable snap-in fork 37 over a pivot pin 38 of the joint 12. The snap-in fork 37 has a resilient snap-in tongue 39, which, following the insertion of the pivot pin 38 into the snap-in fork 37, resiliently snaps in behind the pivot pin 38.

FIG. 17 represents the mounted position of the furniture hinge, within which the connecting arm 36 of the damping cylinder 9 is hingedly connects through the joint 12 to the door fastening element 2. When closing, the damping guidance device 14 comes to rest in the joint 15 and presses the piston rod of the damping cylinder 9 against the joint 13 and displaces the piston in the damping cylinder 9. Accordingly, closing movements of the furniture door 1 is damped as the door 1 moves toward the closed position.

FIG. 18 shows the furniture hinge in accordance with FIG. 17 in the opened position after the connecting arm 36 has been released from its snapped-in connection with the pivot pin 38. With the furniture door 1 open, the entire damping device, consisting of the damping cylinder 9, connecting arm 36, and the damping guidance device 14, is rotatable away from the body fastening element 6 in the manner represented in FIG. 18, so that the three adjustment screws provided at the locations identified with arrows in FIG. 18 are easily accessible. Here, the fastening screw **6*a*** constitutes the height adjustment screw.

In case of mechanical mounting, the housing remains unchanged. If an adjustment of the furniture hinge is necessary following mounting, this adjustment is performed in the opened position represented in FIG. 18. After the adjustment, the snap-in fork 37 is snapped again behind the pivot pin 38.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A furniture hinge comprising:

a door fastening element securable to a furniture door;

a body fastening element securable to a furniture body;

at least one pivot arm connecting said door fastening element with said body fastening element;

a damping device connecting said door fastening element with said body fastening element;

said damping device comprising a linearly movable damping cylinder forming a portion of said damping device and pivotally securable to said door fastening element, and a damping guidance portion pivotally connecting the damping cylinder and pivotally securable to said furniture body, wherein relative pivoting movement of said door fastening element toward said body fastening element moves said damping guidance portion against a pivot stop to initiate linear movement of said damping device to a closed position of said furniture door, wherein the pivot stop is established by at least one of the furniture hinge, the furniture door, or the furniture body.

2. The furniture hinge of claim 1, wherein said damping guidance device comprises a stop face for contacting an abutment face adjacent said body fastening element.

3. The furniture hinge of claim 2, wherein the abutment face is on the furniture body.

4. The furniture hinge of claim 2, wherein said body fastening element comprises the abutment face.

5. The furniture hinge of claim 1, wherein said pivot arm comprises a support arm of a single-joint furniture hinge that is seated on said door fastening element and is fastened to the furniture body, and wherein said dampening guidance device is seated on an end of said body fastening element opposite the furniture door.

6. The furniture hinge of claim 1, including at least two hinge guidance devices, and one of said at least two hinge guidance devices comprises said pivot arm.

7. The furniture hinge of claim 1, wherein a joint element connects said damping guidance device with said door fastening element, said joint element releasably connectable to said door fastening element.

8. The furniture hinge of claim 1, wherein a joint element connects said damping guidance device with said body fastening element, said joint element releasably connectable to said body fastening element.

9. The furniture hinge of claim 1, wherein said door fastening element comprises an insertion cup insertable into a cup bore in the furniture door, said support arm and said damping cylinder together comprise a plurality of joints located in an interior portion of said insertion cup.

10. The furniture hinge of claim 1, wherein said door fastening element comprises an insertion cup insertable into a cup bore in the furniture door, said damping cylinder comprises a joint located on an edge of said insertion cup located outside of the cup bore.

11. The furniture hinge of claim 1, including a guide element for hingedly connecting said damping cylinder to said door fastening element, said guide element pivoting against a stop when said furniture hinge moves to a closed position.

12. The furniture hinge of claim 11, wherein said damping cylinder comprises a stop and said guide element pivots against said stop when said furniture hinge moves to an open position.

13. The furniture hinge of claim 1, wherein said door fastening element comprises a joint and said damping cylinder is seated in a snap-in manner on said joint.

14. The furniture hinge of claim 13, wherein said damping cylinder is rigidly connectable to a connecting arm spring-mountable to a pivot pin of said joint.

15. The furniture hinge of claim 1, wherein said body fastening element includes the pivot stop.

16. A furniture hinge comprising:

a body fastening element securable to a furniture body;

a door fastening element securable to a furniture door and pivotable relative to said body fastening element;

a damping device secured to said door fastening element for damping movement of said door fastening element, said damping device including a linearly movable damping element forming a portion of said damping device and pivotally securable to said body fastening element; and a damping guide portion pivotally connecting the damping element and pivotally securable to said furniture body, wherein relative pivoting movement of said door fastening element toward said body fastening element moves said damping guide portion against a pivot stop to initiate linear damping movement of said damping device, wherein the pivot stop is established by at least one of the furniture hinge, the furniture door, or the furniture body.

* * * * *